US008347429B1

(12) United States Patent
Hawkins

(10) Patent No.: US 8,347,429 B1
(45) Date of Patent: Jan. 8, 2013

(54) EDGE WARNING DEVICES FOR SLEEP SURFACES

(76) Inventor: Randy Hawkins, Travelers Rest, SC (US)

( * ) Notice: Subject to any disclaimer, the term of this patent is extended or adjusted under 35 U.S.C. 154(b) by 0 days.

(21) Appl. No.: 13/360,835

(22) Filed: Jan. 30, 2012

Related U.S. Application Data

(60) Provisional application No. 61/445,157, filed on Feb. 22, 2011.

(51) Int. Cl.
*A47C 9/00* (2006.01)

(52) U.S. Cl. ..... 5/424; 5/657; 5/632

(58) Field of Classification Search ..... 5/630, 632, 5/424, 657, 652
See application file for complete search history.

(56) References Cited

U.S. PATENT DOCUMENTS

| | | | | |
|---|---|---|---|---|
| 1,356,965 | A | 10/1920 | Charles | |
| 4,384,381 | A | 5/1983 | Lowthian | |
| 4,607,402 | A | 8/1986 | Pollard | |
| 4,872,228 | A | 10/1989 | Bishop | |
| 5,023,969 | A | 6/1991 | Nattrass | |
| 5,359,739 | A | 11/1994 | Rains et al. | |
| 5,499,418 | A * | 3/1996 | Tan et al. | 5/655 |
| 5,713,089 | A | 2/1998 | Ferrante | |
| 5,960,492 | A | 10/1999 | Byrne | |
| 5,996,147 | A | 12/1999 | Trimble | |
| 6,311,347 | B1 | 11/2001 | Limardi et al. | |
| 6,862,760 | B2 | 3/2005 | Bradley et al. | |
| D523,679 | S * | 6/2006 | Illingworth | D6/601 |
| 7,107,635 | B2 | 9/2006 | Henry et al. | |
| 7,360,265 | B2 * | 4/2008 | Lamer | 5/655 |
| 7,406,728 | B2 | 8/2008 | VanNeste | |
| 7,533,427 | B2 | 5/2009 | Jackson | |
| 7,647,656 | B2 | 1/2010 | Smith | |
| 7,650,655 | B2 | 1/2010 | Narboni-Campora | |
| 2007/0169264 | A1 | 7/2007 | Spicer et al. | |
| 2007/0294826 | A1 | 12/2007 | Chu | |
| 2008/0216234 | A1 | 9/2008 | Tatsuno | |
| 2008/0289105 | A1 | 11/2008 | Ranzau | |
| 2008/0313809 | A1 | 12/2008 | Inman, II | |
| 2009/0313761 | A1 | 12/2009 | North et al. | |
| 2010/0263122 | A1 | 10/2010 | Papen et al. | |

* cited by examiner

*Primary Examiner* — Fredrick Conley
(74) *Attorney, Agent, or Firm* — Dority & Manning, P.A.

(57) ABSTRACT

A device that warns a sleeper of the locations of the edges of the sleep surface includes two non-rigid sheets wherein one end of each sheet defines a sleeve into which can be inserted a bolster that desirably includes a filler member and a bolster cover, the opposite end of each sheet is provided with mechanical fastener strips such as hook-and-loop strips, in one sheet, the strips desirably are arranged to extend in a direction that has at least one directional component that is perpendicular to the sleeve wherein the second sheet, the free edge of the sheet that is opposite the sleeve end of the sheet is provided with at least one hook-and-loop strip arranged to extend in a direction that is parallel to the sleeve.

14 Claims, 4 Drawing Sheets

FIG. —1—

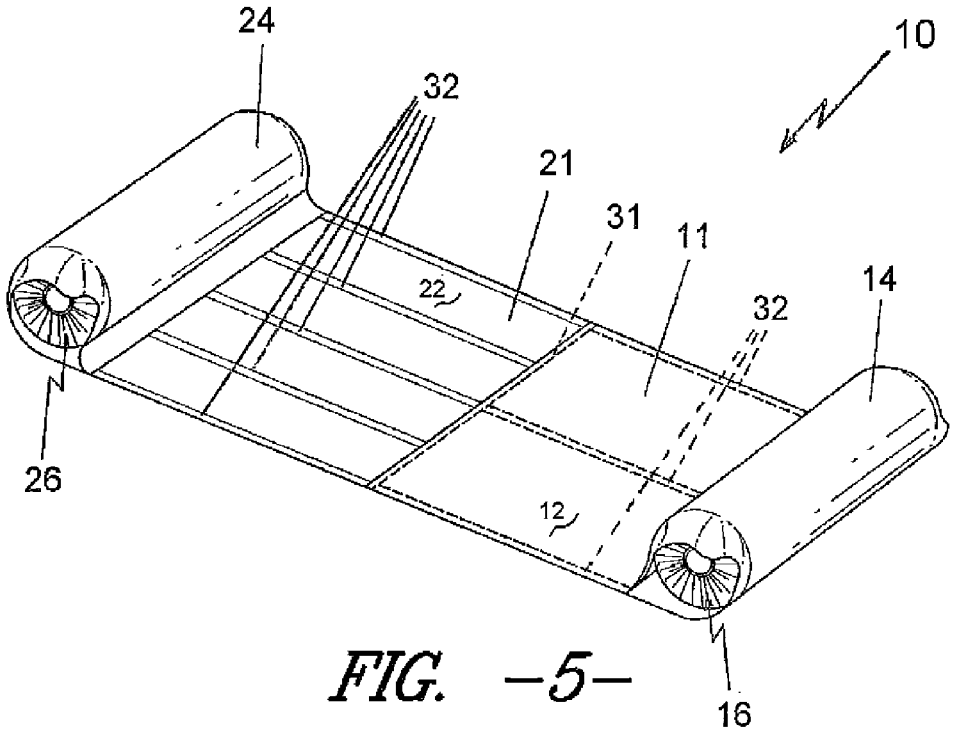
FIG. –5–
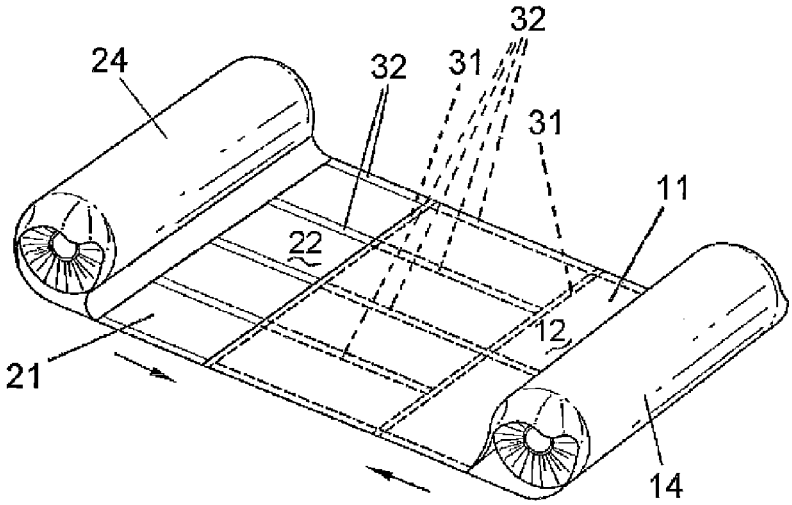
FIG. –6–

EDGE WARNING DEVICES FOR SLEEP SURFACES

CROSS-REFERENCE TO RELATED APPLICATIONS

This application claims priority to U.S. provisional patent application Ser. No. 61-445,157, filed Feb. 22, 2012, which hereby is incorporated herein in its entirety for all purposes.

STATEMENT REGARDING FEDERALLY SPONSORED RESEARCH OR DEVELOPMENT

N/A

BACKGROUND OF THE INVENTION

The present invention concerns devices that warn sleepers of the locations of the edges of the sleep surfaces.

Traveling with small children presents many challenges, both small and large. One such challenge arises when a child must be placed in unfamiliar bedding. A special concern is with a child who is prone to move about during sleep and might thereby roll off the bedding surface and fall to the floor. As explained below, bedding devices that include a pair of bolsters with each one configured to be disposed near one side of a bed and opposite the other one are known.

U.S. Pat. No. 5,359,739 to Rains et al discloses a patient positioning maintenance device. It includes a rectangular sheet of fabric material 10 having at each opposed lengthwise parallel edge, a separate cylindrical pocket 12 containing a cylindrical cushion 14 composed of medical grade, non-hypoallergenic polyurethane material. The distance between the two cylindrical pockets containing the cylindrical cushions 14 is fixed and cannot be adjusted.

U.S. Patent Application Publication No. 2009/0313761 to North et al discloses a first elongate pillow 10 tethered to a second elongate pillow 12 by an intermediate member 14 that is formed of any flexible material for a sleep environment and typically is formed of a material comparable to a bed sheet. The elongate pillows 10 and 12 are disposed in a parallel orientation with respect to each other by the opposed edges of the intermediate member 14. As shown in FIG. 13, each pillow member 12, 12 can comprise a sleeve component 140 configured in a cylindrical shape with an open end 142 for receiving an insert pillow 144 within the cylinder. As shown in FIG. 11, one of the pillows 36 can be detachable to enable fixation at a plurality of locations to vary the length that defines the full transverse span of the intermediate member 33. A single coupling structure 35 is provided on the intermediate member 33 at one end thereof and extends from near the longitudinal edge of the intermediate member 33 towards the first pillow 34 as well as extending the approximate full width of the intermediate member 33. A corresponding strip of a coupling structure 37 is provided along a section of the length of the second pillow 36 for easy attachment or detachment to the corresponding coupling structure 35 of the intermediate member 33. The range of width adjustment between the pillows 34, 36 is limited by the length of the single coupling structure 35 in the lengthwise direction of the intermediate member 33. Moreover, the single coupling structure 35 that is exposed provides an uncomfortable surface on which to rest.

U.S. Pat. No. 6,862,760 to Bradley et al discloses a comforter for a bed that includes a first section 24 and a second section 26 that are releaseably fastened together at a joint 28 by any suitable means. For example, a first strip 46 of hook-and-loop fastener material can be attached to the first fabric sheet and a second strip 48 of mating hook-and-loop fastener material can be attached to the second fabric sheet so that the two strips 46, 48 can cling together to fasten the two sections 24, 26 together. The strips 46, 48 extend substantially end-to-end over the length of their respective sections 24, 26 and spaced a small distance from their respective inner edges 30, 32 so that when the two sections 24, 26 are fastened together, the inner edges 30, 32 overlap at the joint 28, thereby preventing cold air from penetrating the joint 28.

U.S. Pat. No. 5,499,418 to Tan et al discloses a body support for a baby having a single sheet of fabric 3 that is connected between two generally cylindrical cushioned bolsters 1, 2 clothed by a respective bolster cover 10. Two strips 5 of one side of a hook-and-loop releasable fastening material are mounted in parallel on one half of the sheet 3 and span about that entire half of the length of the sheet 3. The strips 5 can mate with strips 6 of the mating side of the strips of hook-and-loop releasable fastening material that are mounted circumferentially on the bolster cover 10 of bolster 1 so that the effective length of the sheet 3 can be reduced by rolling the first bolster 1 under the sheet 3 towards the second bolster 2 so that its cover 10 is fastened to part of the sheet 3. Velcro strips also can be provided on the other side of the sheet 3 and on the cover 10 of the second bolster 2. Two Velcro strips 15 can be provided on the sheet 3 with strips 16 provided on the cover 10 of the other bolster 2 for mating with strips 15 on sheet 3. The strips 15, 16 extend in the direction of the length of the sheet 3 both on the sheet 3 and on the bolster covers 10. In order to be assured of a secure retention of each of the bolsters 1, 2 to the sheet 3, substantially the full length of the strips 5, 15 on the sheet 3 should be mated with the full length of the strips 6, 16 on the cases of the bolsters 1, 2.

However, these devices are somewhat limited when it comes to being adaptable to beds of differing widths and ease of use.

OBJECTS AND SUMMARY OF THE INVENTION

One advantage of embodiments of the present invention is their ease of adaptability to sleep surfaces of differing widths.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the explanation below.

To achieve the objects and in accordance with the purpose of the invention, as embodied and broadly described herein, one presently preferred embodiment of the invention includes two non-rigid sheets. One end of each sheet defines a sleeve into which can be inserted a bolster that desirably includes a filler member contained within the interior space defined by a bolster cover. At least one of the opposite ends of each bolster cover desirably is at least partially open and desirably can be constricted toward closure by an elastic cord received within a hem formed about each periphery of that at least one end of the bolster cover. The filler member desirably is formed in a cylindrical shape or can be compressed to assume such shape when inserted into the bolster cover. Desirably, the sleeve on one end of each sheet is distinct from the cloth that forms the bolster cover. On at least part of the portion of each sheet that does not form the sleeve, mechanical fastener strips such as hook-and-loop strips are disposed on one of the opposite surfaces of the sheet. In one sheet, the mechanical fastener strips desirably are arranged to extend in a direction that has at least one directional component that is perpendicular to the axial direction of sleeve elongation. In the other sheet, at least the free edge of the sheet that is opposite the sleeve end of the sheet desirably is provided with at least one mechanical fastener strip arranged to extend in a direction that has at least one directional component that is parallel to the axial direction of sleeve elongation.

Thus, one of the two sheets has a mechanical fastener strip spanning the width of the sheet on one end thereof and facing upwardly. While the other sheet has at least one and preferably a plurality of mating mechanical fastener strips extending in the direction of the length of that other sheet and facing downwardly. In such a configuration, the edge of the first sheet can be grasped by the parallel lengthwise mechanical fastener strips on the second sheet at any point along the length of the second sheet as desired or necessary to adjust the length of the span covered by the connected sheets.

In operation, the device is used with bedding and warns the user of the location of the edge of the bed. in a hotel setting for example, the bottom sheet would be removed from the mattress and the two sheets of the device would be laid down on the mattress and the free edges of the two sheets would be adjusted with the mechanical fastener strips to accommodate whatever is the width of the bed. The sheets of the device are sized so that they only cover about the third of the mattress that is disposed closest to the head of the bed. Then the bottom sheet would be replaced and cover the two sheets of the device at the head of the mattress. Then the ends of the bottom sheet would be tucked under the head and foot of the mattress.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

BRIEF DESCRIPTION OF THE DRAWINGS

FIG. 5 depicts a presently preferred embodiment of the edge warning device in an elevated perspective view with portions otherwise hidden from the viewer shown in dashed line and portions cut away.

FIG. 6 depicts a presently preferred embodiment of the edge warning device in an elevated perspective view with portions otherwise hidden from the viewer shown in dashed line and portions cut away.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
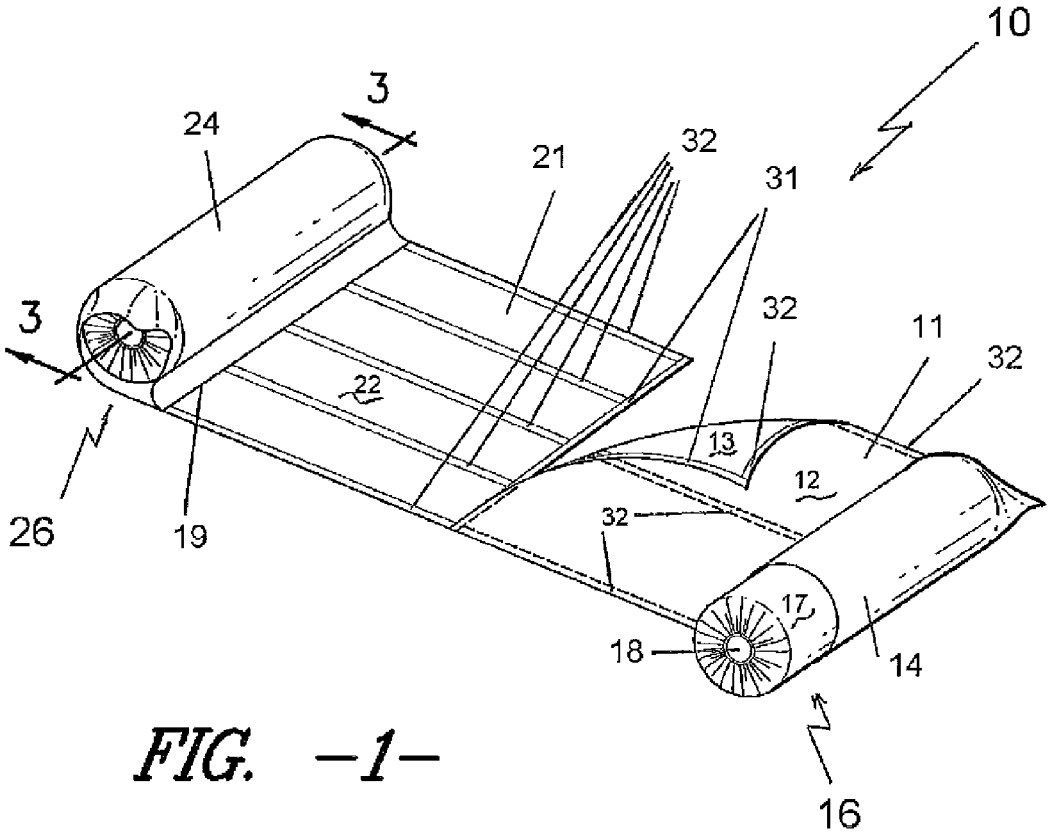
FIG. 1 depicts a presently preferred embodiment of the edge warning device in an elevated perspective view with portions otherwise hidden from the viewer shown in dashed line and portions cut away.

A presently preferred embodiment of the edge warning device is shown in FIGS. 1 and 5 and is represented generally by the numeral 10. As depicted therein, a presently preferred embodiment of the invention includes two non-rigid sheets 11, 21. As shown in FIG. 1, a first non-rigid sheet 11 defines a top surface 12 and a bottom surface 13 disposed opposite the top surface 12. As shown in FIGS. 1 and 5, a first sleeve 14 is defined at one end of the first sheet 11 and extends in an axial direction to define a hollow tubular member.

Figure 3:
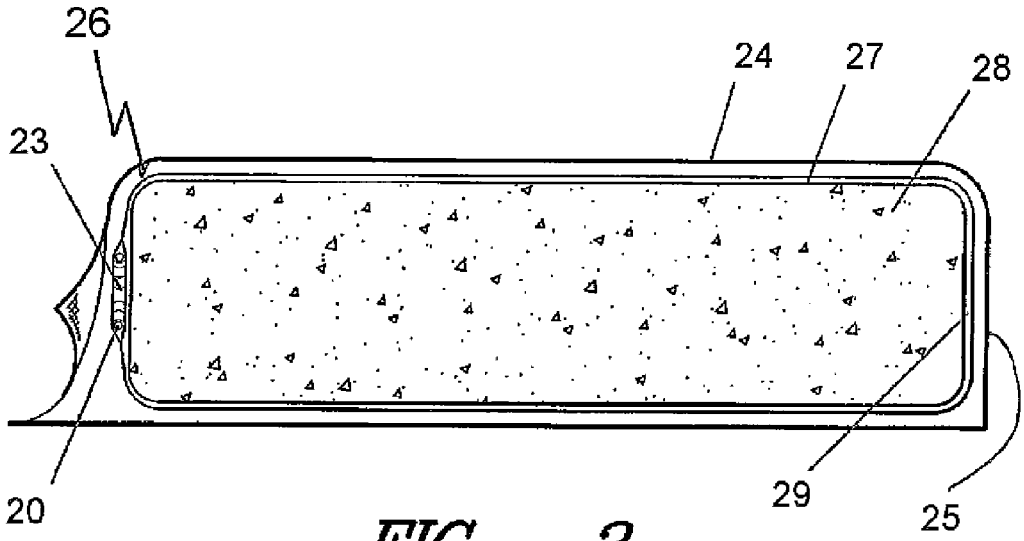
FIG. 3 depicts a cross-sectional view taken along the line of sight indicated by the arrows labeled 3-3 in FIG. 1.

As shown in FIGS. 1 and 5 for example, a second non-rigid sheet 21 is essentially identical to the first sheet 11 and defines a top surface and a bottom surface that is disposed opposite the top surface. A second sleeve 24 is defined at one end of the second sheet 21 and extends in an axial direction to define a hollow tubular member. Accordingly, one end of each sheet 11, 21 defines a respective hollow cylindrical sleeve 14, 24. Each of the first sleeve 14 and the second sleeve 24 desirably is open at each opposite end. However, one end of the first sleeve 14 and one end of the second sleeve 24 can be closed. As shown in FIG. 3 for example, the second sleeve 24 can have a closed end 25 and remain open at the opposite end.

Each of the first sheet 11 and the second sheet 21 desirably is a drapeable, thin sheet formed of an air permeable, light weight fabric such as cotton, but can be formed by other natural or synthetic fibers. Each of the first sleeve 14 and the second sleeve 24 desirably is made from the same material as the respective first sheet 11 and second sheet 21 and can be formed of a unitary piece of such material, but also can be formed as separate pieces of material that either are permanently joined to one another or detachably joined together along a seam such as the seam designated 19 in FIG. 1 for example.

As shown in FIG. 1 for example, a first bolster 16 desirably includes a first bolster cover 17 and a first filler member 18 extending in an axial direction and inserted into the hollow interior space surrounded by the first bolster cover 17. The first bolster cover 17 desirably is formed of the same air permeable, light weight fabric that forms the first sheet 11. However, the first bolster cover 17 can be formed of different material than is used to form the first sheet 11. The first filler member 18 gives shape and definition to the shape of the first bolster 17 and desirably is formed of material that is lightweight, soft, resiliently compressible so that it holds its shape in the absence of a threshold level of force being applied to it and non-toxic such as open cell polyurethane foam material. However, other soft materials that hold their shape can be used.

A second bolster 24 desirably is constructed identically to the first bolster 14. Thus, as shown in FIG. 3 for example, a second bolster 26 desirably includes a second bolster cover 27 and a second filler member 28 extending in an axial direction and inserted into the hollow interior space that is surrounded and defined by the second bolster cover 27.

At least one opposite end of each of the first bolster cover 17 and the second bolster cover 27 desirably is at least partially open. As shown in FIG. 3 for example, one partially open end of the second bolster cover 27 desirably is constricted toward closure by an elastic cord 20 received within a hem 23 formed about the periphery of the partially open end of the bolster cover 27. The elastic cord 20 can be stretched to permit passage of the second filler member 28 into the second bolster cover 27 or to permit the second filler member 28 to be withdrawn from within the second bolster cover 27 in order to permit laundering of the cover and/or filler member 28. A similar cord and hem is provided on at least one end of the first bolster cover 17.

Because the respective sleeve 14, 24 on one end of the respective sheet 11, 21 is distinct from the material that forms the bolster cover 17, 27, the respective sheet 11, 21 can be laundered separately from the respective bolster cover 17, 27.

As shown in FIG. 3 for example, one end of the second bolster cover 27 desirably is defined by a closed end 29. A similar closed end desirably is provided on at least one end of the first bolster cover 17.

One of the opposite ends of each of the first sleeve 14 and the second sleeve 24 desirably remains open. As shown in FIG. 1 for example, the first bolster 16 desirably is received within the hollow interior of the first sleeve 14. Similarly, as shown in FIGS. 1 and 3 for example, the second bolster 26 desirably is received within the hollow interior of the second sleeve 24. The clearance between the interior surface of each sleeve 14, 24 and the exterior surface of each respective bolster 16, 26 received within the hollow interior of that respective sleeve 14, 24 desirably allows the friction generated between these surfaces to suffice to retain the bolster 16, 26 in place within the respective sleeve 14, 24 under ordinary conditions of deployment of the device 10 on a sleeping surface while allowing removal of the bolster 16, 26 from within the sleeve 14, 24 without the application of strenuous manual effort.

At the end of each sheet 11, 21 opposite to where the respective sleeve 14, 24 is formed, at least one of the opposite surfaces of the sheet 11, 21 is provided with mechanical fasteners so that part of the bottom surface of one sheet 11 or 21 can overlie part of the top surface of the other sheet 11 or 21 and the two sheets 11, 21 then can be selectively detachably joined together. The mechanical fasteners desirably are configured so that they easily can be manually connected or disconnect repeatedly according to the desire of the user. Hook-and-loop strips desirably can be used for the mechanical fasteners.

As shown in FIG. 1 for example, at least a first elongated mechanical fastener strip 31 is attached on the leading edge of one surface of the first sheet 11 in a manner arranged to extend in a direction that has at least one directional component that is perpendicular to the axial direction in which the first sheet 11 extends and parallel to the axial direction in which the first sleeve 14 extends. Though not depicted in the FIGs., it also is contemplated to have at least one additional mechanical fastener strip 31 disposed between the one shown in FIG. 1 and the first sleeve 14, and this additional at least one mechanical fastener strip 31 can be disposed desirably in a manner parallel to the mechanical fastener strip 31 on the leading edge of the first sheet 11 or desirably at some predetermined acute angle with respect to the mechanical fastener strip 31 on the leading edge of the first sheet 11.

Desirably, at least another mechanical fastener strip 32, and more desirably each of a plurality of additional mechanical fastener strips 32, is attached on the same bottom surface 13 of the first sheet 11 in a manner arranged to extend in a direction that has at least one directional component that is parallel to the axial direction in which the first sheet 11 extends and perpendicular to the axial direction in which the first sleeve 14 extends. In the deployment of the first sheet 11 depicted in FIG. 1, each of a plurality of the sheet parallel mechanical fastener strips 32 is deployed so as to extend in a direction that is perpendicular to the axial direction in which the first sleeve 14 extends. In the deployment of the first sheet 11 depicted in FIG. 1, the sleeve parallel strip 31 and the sheet parallel strips 32 are arranged on the bottom surface 13 of the first sheet 11. However, in alternative embodiments, the sheet parallel mechanical fastener strips 32 can be deployed at different angles with respect to the axial direction in which the first sleeve 14 extends and the sheet parallel mechanical fastener strips 32 can in fact criss-cross one another in one or more places along their lengths.

As shown in FIG. 1 for example, at least one elongated sleeve parallel mechanical fastener strip 31 is attached on the leading edge of one surface of the second sheet 21 in a manner arranged to extend in a direction that has at least one directional component that is perpendicular to the axial direction in which the second sheet 21 extends and parallel to the axial direction in which the second sleeve 24 extends. Though not depicted in the FIGs., it also is contemplated to have at least one additional mechanical fastener strip 31 disposed between the one shown in FIG. 1 and the second sleeve 24, and this additional at least one mechanical fastener strip 31 can be disposed desirably in a manner parallel to the mechanical fastener strip 31 on the leading edge of the second sheet 21 or desirably at some predetermined acute angle with respect to the mechanical fastener strip 31 on the leading edge of the second sheet 21.

Desirably, each of a plurality of additional mechanical fastener sheet parallel strips 32 is attached on the same surface of the second sheet 21 in a manner arranged to extend in a direction that has at least one directional component that is parallel to the axial direction in which the second sheet 21 extends and perpendicular to the axial direction in which the second sleeve 24 extends. In the deployment of the second sheet 21 depicted in FIG. 1, each of the sheet parallel strips 32 is arranged parallel to each of the other sheet parallel strips 32, but it is possible for one or more of them to be arranged in a manner that is not parallel to any of the other sheet parallel strips 32. In the deployment of the second sheet 21 depicted in FIG. 1, the sleeve parallel strip 31 and the sheet parallel strips 32 are arranged on the top surface 22 of the second sheet 21 and in a manner such that the sleeve parallel strip 31 extends in a direction that is normal to the direction in which each of the sheet parallel strips 32 is arranged. However, it is possible for one or more of the sheet parallel strips 32 to be arranged in a manner that is not normal to the sleeve parallel strip 31. In alternative embodiments, the sheet parallel mechanical fastener strips 32 can be deployed at different angles with respect to the axial direction in which the second sleeve 24 extends and can in fact the sheet parallel mechanical fastener strips 32 criss-cross one another in one or more places along their lengths.

Note in FIG. 1 that the sleeve parallel fastener strip 31 (indicated partly in solid line and partly in dashed line) deployed on the leading edge of the top surface 22 of the second sheet 21 is aligned with and thereby engaged by the sleeve parallel fastener strip 31 (indicated partly in solid line and partly in dashed line) deployed on the leading edge of the bottom surface 13 of the first sheet 11. FIG. 1 depicts the state of the device 10 when the two sheets 11, 21 are being selectively attached by the user or selectively detached by the user. While FIG. 5 depicts the state of the device 10 when the two sheets 11, 21 are fully connected to each other, yet deployed with the same arrangement of spacing between the two sleeves 14, 24 as depicted in FIG. 1.

In both the FIG. 1 configuration and the FIG. 5 configuration, the two sheets 11, 21 are selectively, detachably joined to each other so that there is the maximum distance between the first sleeve 14 and the second sleeve 24. However, unlike the configuration depicted in FIGS. 1 and 5, in the configuration depicted in FIG. 6, the first sheet 11 and the second sheet 21 are selectively, detachably joined to each other so that there is less than the maximum distance between the first sleeve 14 and the second sleeve 24.

Note in FIG. 6 that each of the sheet parallel fastener strips 32 deployed on the top surface 22 of the second sheet 21 will be crossed by and thereby engaged by the sleeve parallel fastener strip 31 (indicated in dashed line) deployed on the leading edge of the bottom surface 13 (FIG. 1) of the first sheet 11. Moreover, each of the sheet parallel fastener strips 32 (indicated in dashed line) deployed on the bottom surface 13 (FIG. 1) of the first sheet 11 will be crossed by and thereby engaged by the sleeve parallel fastener strip 31 deployed on the leading edge of the top surface 22 of the second sheet 21.

Note in FIG. 6 that each one of several of the sheet parallel fastener strips 32 (indicated partly in solid line and partly in dashed line) deployed on the top surface 22 of the second sheet 21 will be aligned with and thereby engaged by a corresponding one of several of the sheet parallel fastener strips 32 (indicated entirely in dashed line) deployed on the bottom surface 13 (FIG. 1) of the first sheet 11.

Figure 2:
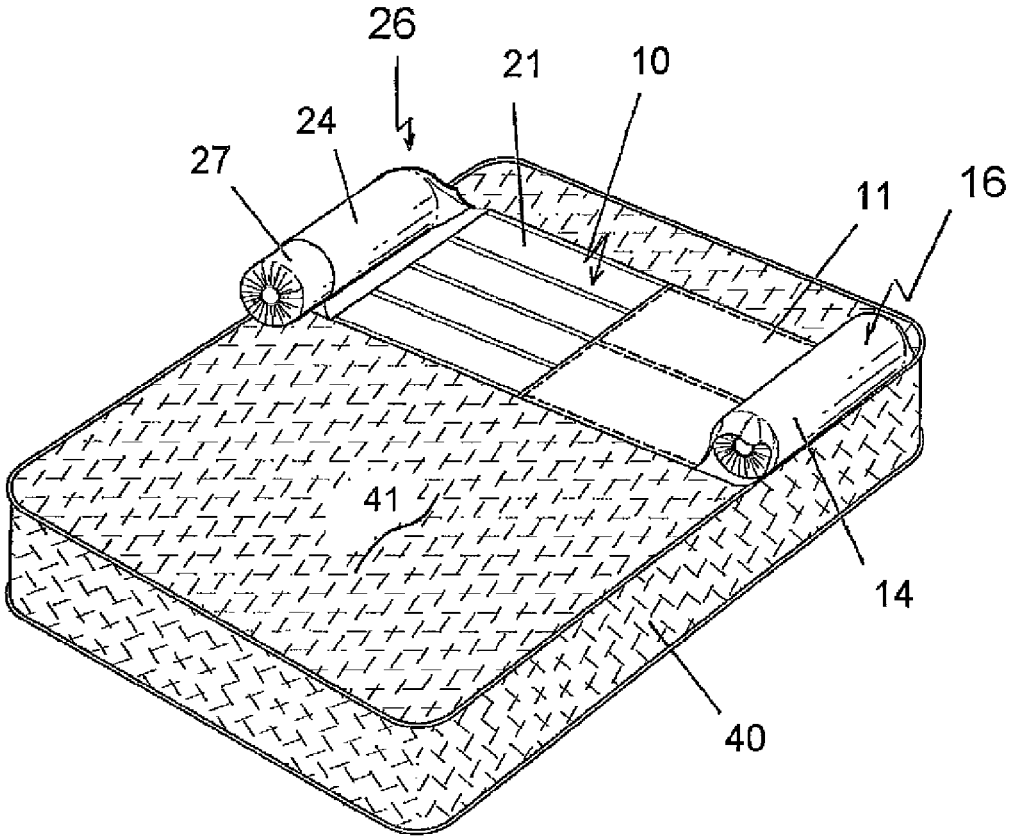
FIG. 2 depicts a presently preferred embodiment of the edge warning device disposed on a mattress in an elevated perspective view with portions otherwise hidden from the viewer shown in dashed line, portions cut away, and portions partially displaced from their normal disposition.

The edge warning device 10 is used with bedding and desirably can be deployed so as to warn the user reclined between the sleeves 14, 24 containing the respective bolsters 16, 26 of the location of the edge of the bed. In a hotel setting for example and as depicted in FIG. 2, the bottom sheet of the bed linen would be removed from the mattress 40 and the sheets 11, 21 of the device 10 would be laid down on the upper-facing surface 41 of the mattress 40. The sleeve parallel fastener strips 31 on the free edges of the two sheets 11, 21 could be adjusted with the sheet parallel fastener strips 32 of the two sheets 11, 21 to accommodate whatever is the width of the bed's mattress 40. As schematically shown in FIG. 2, the width of each of the sheets 11, 21 (measured in the direction that is parallel to the direction in which the respective sleeve 14, 24 elongates) of the device 10 is sized so that it only covers about the third of the mattress 40 closest to the head of the bed.

Figure 4:
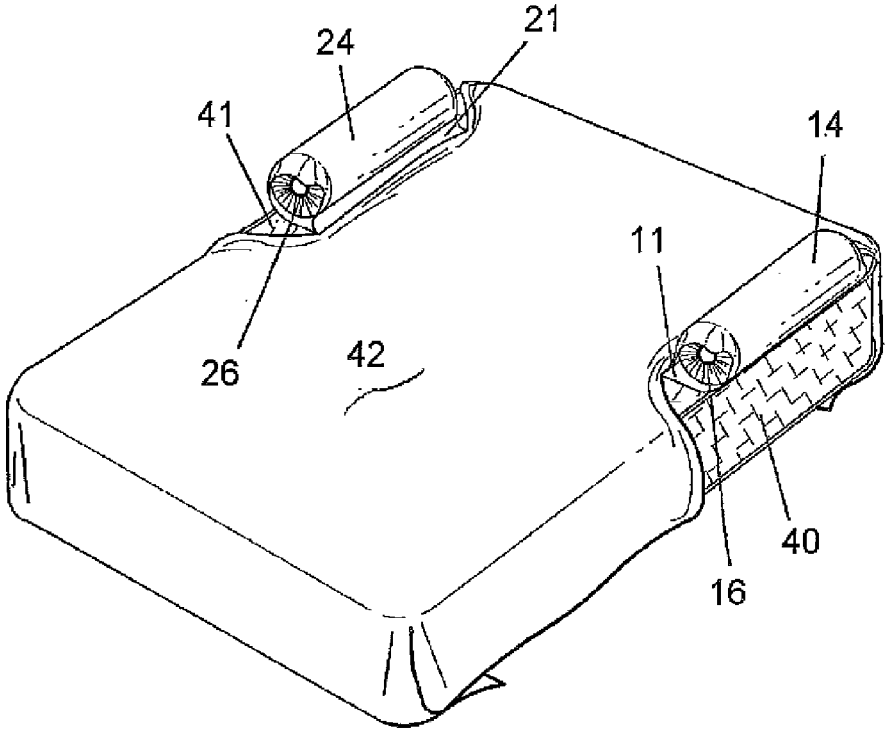
FIG. 4 depicts a presently preferred embodiment of the edge warning device disposed on a mattress in an elevated perspective view with portions covered by a bedding top sheet and hidden from the viewer.

Then as shown schematically in FIG. 4 for example, the bottom sheet 42 of the bed linen would be replaced and cover the two sheets 11, 21 of the edge warning device 10 at the head of the mattress 40. Then the ends of the bottom sheet 42 of the bed linen would be tucked under the head and foot of the mattress 40, leaving only the two bolsters 16, 26 uncovered by the bed linen bottom sheet 42 with the two bolsters 16, 26 disposed spaced apart from each other and near one of the edges of the sleeping surface 41 to give warning of that edge to someone lying between the bolsters 16, 26.

As shown in FIG. 6, for example, in the adjustable attachment of the two non-rigid sheets 11, 21, the points of attachment between the two sheets 11, 21 are not restricted as to location by the need to connect snaps or zippers or buttons or ties. Instead, the sheets 11, 21 are attachable together anywhere along a continuum with the hook-and-loop fastener strips 31, 32 and permit the distance between the two bolsters 16, 26 to be easily adjusted for a bed (or other surface) of any width.

While at least one presently preferred embodiment of the invention has been described using specific terms, such description is for illustrative purposes only, and it is to be understood that changes and variations may be made without departing from the spirit or scope of the following claims.

What is claimed is:

1. An edge warning device comprising:

a first non-rigid sheet defining a top surface and a bottom surface disposed opposite said top surface, one end of said first sheet defining a first sleeve extending in an axial direction;

a second non-rigid sheet, one end of said second sheet defining a second sleeve extending in an axial direction;

a first bolster including a first bolster cover and a first filler member extending in an axial direction and inserted into said first bolster cover, said first bolster received in said first sleeve of said first sheet;

a second bolster including a second bolster cover and a second filler member extending in an axial direction and inserted into said second bolster cover, said second bolster received in said second sleeve of said second sheet;

at least a first elongated mechanical fastener strip attached on the bottom surface of said first sheet in a manner arranged to extend in a direction that has at least one directional component that is parallel to the axial direction in which the first sleeve extends; and at least a second elongated mechanical fastener strip attached on the top surface of said second sheet in a manner arranged to extend in a direction that has at least one directional component that is perpendicular to the axial direction in which the second sleeve extends; and wherein the distance between the first sleeve and the second sleeve is selectively variable from zero to substantially the sum of the distances of the free edge of each sheet to the sleeve of the respective sheet by overlying a selective region of the first elongated mechanical fastener strip with the second elongated mechanical fastener strip so as to selectively detachably join the first sheet to the second sheet with a predetermined distance between the first sleeve and the second sleeve.

2. An edge warning device as in claim 1, wherein each of said first and second mechanical fastener strips is defined by a hook-and-loop strip.

3. An edge warning device as in claim 1, wherein at least one end of each sleeve is closed.

4. An edge warning device as in claim 1:

wherein at least one opposite end of each of the first bolster cover and the second bolster cover is at least partially open, and wherein one partially open end of at least one of the bolster covers is constricted toward closure by an elastic cord received within a hem formed about the periphery of the partially open end of the bolster cover.

5. An edge warning device as in claim 1, wherein each of a plurality of mechanical fastener strips is attached on the bottom surface of said first sheet and is deployed so as to extend in a direction that is perpendicular to the axial direction in which the first sleeve extends.

6. An edge warning device as in claim 5, wherein at least one elongated mechanical fastener strip is attached on the bottom surface at the leading free edge of said first sheet in a manner arranged to extend in a direction that is parallel to the axial direction in which the first sleeve extends.

7. An edge warning device as in claim 6, wherein at least a second elongated mechanical fastener strip is attached on the bottom surface between the first sleeve and the leading free edge of said first sheet in a manner arranged to extend in a direction that is parallel to the axial direction in which the first sleeve extends.

8. An edge warning device as in claim 1, wherein each of a plurality of mechanical fastener strips is attached on the top surface of said second sheet and is deployed so as to extend in a direction that is perpendicular to the axial direction in which the second sleeve extends.

9. An edge warning device as in claim 8, wherein at least one elongated mechanical fastener strip is attached on the bottom surface at the leading free edge of said second sheet in a manner arranged to extend in a direction that is parallel to the axial direction in which the second sleeve extends.

10. An edge warning device as in claim 1, wherein each of a plurality of mechanical fastener strips is attached on the bottom surface of said first sheet and is deployed so as to extend in a direction that has at least one directional component that is parallel to the axial direction in which the first sleeve extends.

11. An edge warning device as in claim 10, wherein at least one elongated mechanical fastener strip is attached on the bottom surface at the leading free edge of said first sheet in a manner arranged to extend in a direction that is parallel to the axial direction in which the first sleeve extends.

12. An edge warning device as in claim 11, wherein at least a second elongated mechanical fastener strip is attached on the bottom surface between the first sleeve and the leading free edge of said first sheet in a manner arranged to extend in a direction that has at least one directional component that is parallel to the axial direction in which the first sleeve extends.

13. An edge warning device as in claim 1, wherein each of a plurality of mechanical fastener strips is attached on the top surface of said second sheet and is deployed so as to extend in a direction that has at least one directional component that is perpendicular to the axial direction in which the second sleeve extends.

14. An edge warning device as in claim 13, wherein at least one elongated mechanical fastener strip is attached on the bottom surface at the leading free edge of said second sheet in a manner arranged to extend in a direction that is parallel to the axial direction in which the second sleeve extends.

* * * * *